United States Patent [19]

Scheler

[11] Patent Number: 4,540,648

[45] Date of Patent: Sep. 10, 1985

[54] TWO-COMPONENT DIAZOTYPE MATERIAL WITH ULTRAVIOLET LIGHT-ABSORBING DYE SALT OF A BENZOTHIAZOLE

[75] Inventor: Siegfried Scheler, Wiesbaden, Fed. Rep. of Germany

[73] Assignee: Hoechst Aktiengesellschaft, Frankfurt am Main, Fed. Rep. of Germany

[21] Appl. No.: 584,547

[22] Filed: Feb. 28, 1984

[30] Foreign Application Priority Data

Mar. 2, 1983 [DE] Fed. Rep. of Germany ..... 3307364

[51] Int. Cl.[3] ..... G03C 1/60; G03C 1/54; G03C 1/58

[52] U.S. Cl. ..... 430/172; 430/148; 430/150; 430/173; 430/174; 430/176; 430/178; 430/179; 430/171

[58] Field of Search ..... 430/178, 179, 148, 172, 430/171

[56] References Cited

U.S. PATENT DOCUMENTS

| | | | |
|---|---|---|---|
| 3,365,293 | 1/1968 | Haefeli et al. | 430/179 |
| 3,365,296 | 1/1968 | Cox et al. | 96/91 |
| 3,661,591 | 5/1972 | Reed | 430/148 |
| 3,679,415 | 7/1972 | McNally | 96/68 |
| 4,142,898 | 3/1979 | Izu | 430/162 |
| 4,224,397 | 9/1980 | Zweig | 430/148 |

FOREIGN PATENT DOCUMENTS

| | | | |
|---|---|---|---|
| 2333378 | 6/1973 | Fed. Rep. of Germany | . |
| 726755 | 3/1955 | United Kingdom | . |
| 871216 | 6/1961 | United Kingdom | . |
| 1151368 | 5/1969 | United Kingdom | . |
| 1294360 | 10/1972 | United Kingdom | 430/179 |

*Primary Examiner*—Charles L. Bowers, Jr.
*Attorney, Agent, or Firm*—Schwartz, Jeffery, Schwaab, Mack, Blumenthal & Evans

[57] ABSTRACT

The present invention relates to a two-component diazotype material comprising a support and one or several light-sensitive layers, each of which contains at least one light-sensitive diazonium salt, a coupler component and an acid stabilizer, and at least one of the layers contains a compound which absorbs light in the ultraviolet spectral region. The light-absorbing compound is present in the form of a dye salt of at least one benzothiazole which is converted into its leuco base under the action of an alkaline medium. It thus partially or completely loses its absorptivity toward radiation in the long-wave ultraviolet and short-wave visible spectral regions. The light-absorbing compound comprises a benzothiazole, in particular according to the general formula:

wherein $R_1$ denotes hydrogen, alkyl or aralkyl, $R_2$ denotes hydrogen or an optionally substituted alkyl, aralkyl, aryl, pyridylalkyl, carbalkyl, carboxyalkyl, carboxyaryl, carbamoyl, or sulfamoyl radical, or $R_1$ and $R_2$ denote members of a heterocyclic radical, and $R_3$ denotes hydrogen or alkyl.

19 Claims, 5 Drawing Figures

TWO-COMPONENT DIAZOTYPE MATERIAL WITH ULTRAVIOLET LIGHT-ABSORBING DYE SALT OF A BENZOTHIAZOLE

BACKGROUND OF THE INVENTION

The present invention relates to a two-component diazotype material comprising a support and one or several light-sensitive layers, each of which contains at least one light-sensitive diazonium salt, a coupler component, and an acid stabilizer, wherein at least one of the layers contains a compound which absorbs light in the ultraviolet spectral region.

Two-component diazotype materials are known in the art. They generally comprise a coating containing at least one light-sensitive diazonium salt and at least one coupler component which couples with the diazonium salt in an alkaline medium to form an azo dye. The light-sensitive coating of diazotype materials may comprise one or several layers, and each of these layers contains at least one diazonium salt and at least one coupler component. In addition, the layers usually contain further additives, for example, acid stabilizers to prevent premature dye coupling, thiourea to improve the image background, and sterically hindered phenols to increase the fastness to light of the azo dyes, and further additives, which are conventionally used in diazotype printing.

Diazotype materials have a very steep gradation and they consequently yield copies of very high contrast. They are therefore particularly suitable for improving reproductions such as line drawings, book copies, and other large-surface black and white copies, e.g., half-tone dot patterns, since upon imagewise exposure, the diazonium salt is generally completely destroyed in the areas which have been struck by actinic radiation. Due to this characteristic, diazotype materials are normally not suited for the reproduction of continuous tone originals, since they do not yield a true-tone reproduction of details in highlight image areas.

In order to obtain improved reproductions of continuous tone originals by means of such diazotype materials, it has already been proposed to use several diazonium salts of different light-sensitivities (British Pat. No. 726,755). The diazonium salt having the higher sensitivity to light is more rapidly decomposed so that contrast in the high-density image areas is increased. The diazonium compound which has the lower sensitivity to light remains undecomposed for a longer period of time and, as a result, contrast in the lower-density image areas is reduced. This method has, however, the disadvantage that the pairs of diazonium salts of different light-sensitivities form dyes of different color shades and will, moreover, couple at different speeds. Thus an image is produced in which the color shade generated in the high-density areas differs from that generated in the lower-density areas ("two-tone effect"). It is also a disadvantage that copying speed is adversely affected by the presence of the diazonium salt which is less sensitive to light.

It is also known to add a yellow dye to the light-sensitive layer, to render the sensitometric characteristics of the diazotype material prepared therefrom generally softer, i.e., to flatten gradation. This method has the disadvantage that a considerable quantity of yellow dye is necessary for contrast softening. The quantity of dye which is required reduces copying speed and leads, moreover, to a noticeable reduction in the overall contrast of the copy.

German Pats. No. 1,204,069 (corresponding to British Pat. No. 871,216) and No. 1,263,505 (corresponding to U.S. Pat. No. 3,365,296) disclose materials which make it possible to obtain a nearly correct rendering of tones in the reproduction of continuous tone originals. The diazotype material according to German Pat. No. 1,204,069 is constructed of several layers, one of which absorbs ultraviolet light. The diazotype material described in German Pat. No. 1,263,505 comprises a single layer which contains the diazonium salt, the coupler component and, in addition, an ultraviolet absorbing compound which effectively absorbs radiation in the spectral region from 300 to 460 nm and is changed by actinic radiation in such a way that it is no longer capable of absorbing radiation in this spectral region. These diazotype materials have the disadvantage that the compounds which absorb ultraviolet light produce an undesired staining in the highlight image areas, because they are either not decomposed or only incompletely decomposed by the action of light and are thus still present in the final copy. In addition, the ultraviolet absorbing compound which is still present in the developed copy renders the image extremely impermeable to ultraviolet radiation, resulting in undesirably long exposure times when the copy is used as an intermediate original.

German Pat. No. 2,035,392 (corresponding to U.S. Pat. No. 3,679,415) discloses a diazotype material for the reproduction of continuous tone originals which contains, as the ultraviolet absorbing compound, a specific pyrylium or thiapyrylium salt, which is completely bleachable in an alkaline medium. The disclosed diazotype material has an extended exposure latitude and shows hardly any staining in the highlight image areas. The material comprises several superimposed, light-sensitive layers, each of which contains at least one diazonium salt and at least one coupler component. At least one of these layers contains the alkaline bleachable pyrylium or thiapyrylium salt as the compound which absorbs ultraviolet light. The pyrylium and thiapyrylium salts, respectively, are, for example, obtained from acetophenone and benzaldehyde in 3 or 4 reaction steps which involve a very expensive technology and result in yields of only about 20 to 30%, based on the starting materials employed. (See K. Dimroth, Angewandte Chemie ("Applied Chemistry"), 72d year, 1960, No. 10, pages 331 to 342). Since it is relatively difficult to obtain these pyrylium and thiapyrylium salts, the commercial application of a corresponding diazotype material is limited.

SUMMARY OF THE INVENTION

It is therefore an object of the present invention to provide an improved diazotype material.

It is another object of the invention to provide a diazotype material having a flat gradation.

Still another object of the invention resides in providing a diazotype material which is suitable for the reproduction of continuous tone originals and yields high-quality continuous tone copies, which displays no or only very slight background staining, and which can be used for the production of further copies, without any significant reduction in copying speed or loss of quality.

It is also an object of the invention to provide a diazotype material which can be prepared according to a simple technical method and at low cost.

In accomplishing these objects, there has been provided according to the present invention a two-component diazotype material in which the light-absorbing compound is present in the form of a dye salt of at least one benzothiazole which is converted into its leuco base by the action of an alkaline medium, and thus partially or completely loses its absorptivity towards radiation in the long-wave ultraviolet and short-wave visible spectral regions.

Further objects, features and advantages of the present invention will become apparent when considered with the following detailed description of preferred embodiments, together with the attached figures of drawing.

DETAILED DESCRIPTION OF PREFERRED EMBODIMENTS

Figure 1:
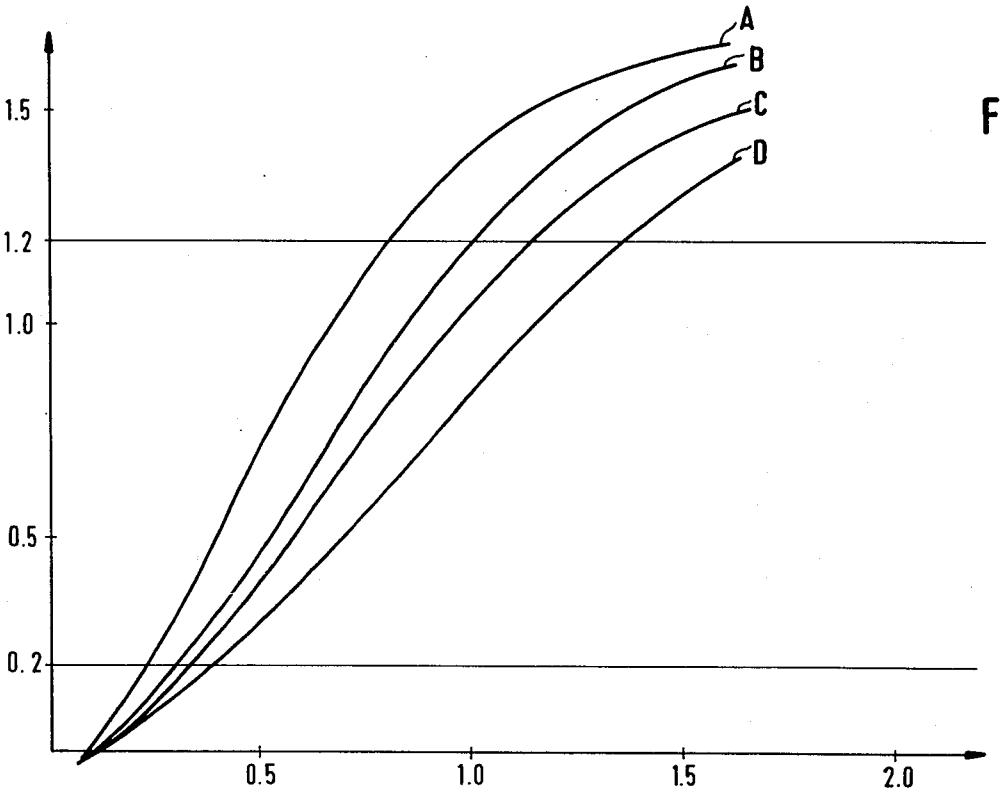
FIGS. 1–5 depict in graphical form sensitometric data derived from comparative tests of prior art diazotype material and diazotype material within the present invention, respectively.

The light-absorbing compound preferably comprises a benzothiazole, in particular a benzothiazole of the formula:

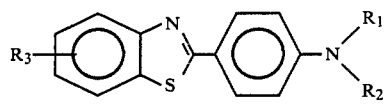

(I)

wherein $R_1$=hydrogen, alkyl or aralkyl, $R_2$=hydrogen or an optionally substituted alkyl, aralkyl, aryl, pyridylalkyl, carbalkyl, carboxyalkyl, carboxyaryl, carbamoyl or sulfamoyl radical or $R_1$ and $R_2$=members of a heterocyclic radical, and $R_3$=hydrogen or alkyl.

In particular:

$R_1$=hydrogen, an alkyl having from 1 to 4 carbon atoms or an aralkyl having up to 10 carbon atoms, $R_2$=hydrogen or an alkyl radical having from 1 to 4 carbon atoms, or an aralkyl radical having up to 10 carbon atoms or an aryl radical, a pyridylalkyl radical having from 1 to 4 carbon atoms in the alkyl group, a carbalkyl radical having from 1 to 4 carbon atoms, a carboxyalkyl radical having from 1 to 4 carbon atoms, a carboxyaryl radical having up to 10 carbon atoms, a carbamoyl or sulfamoyl radical, said radicals being substituted by halogen, amino, mono- or dialkylamino, cyano, alkyl, alkoxy or alkylenedioxy groups which have, in each case, from 1 to 3 carbon atoms in the alkyl radical or $R_1$ and $R_2$=together with the nitrogen atom to which they are bonded, members of a five or six-membered heterocyclic racial, and $R_3$=hydrogen or alkyl having 1 to 2 carbon atoms.

In accordance with the present invention, it is possible to provide a two-component diazotype material which displays a flat gradation relative to prior art diazotype materials, which yields high-quality reproductions of continuous tone originals exhibiting no or only very slight background staining, and which is highly suitable for the production of further copies, without appreciable reductions in copying speed. Compared with the known alkaline bleachable pyrylium or thiapyrylium salts, the benzothiazole compounds of the present invention can be produced and processed by a considerably easier method and at lower cost. In addition, the completely exposed, colorless background of a film copy produced by means of the two-component diazotype material of the invention is bathochromically shifted to yellow by rconversion of the benzothiazole dye salt, under the action of an acid medium, for example, an acid gas or an acid solution. In a diazotype copy which has been post-treated in this manner, further duplicating on diazotype material is extremely restricted. It is particularly desirable to have film copies which cannot be further duplicated in those cases in which it is intended to prevent the making of a further copy, a so-called pirated copy, from a copyrighted film original.

Examples of compounds which absorb light in the region from about 320 to 450 nm and which can be used in the diazotype material of the present invention are compiled in the attached table of formulas. In the table, the base ("leuco base") from which the corresponding dye salt is derived is, in each case, characterized by its melting point.

Benzothiazole leuco bases are known in the art, and some of them are commercially available. They can be prepared by condensing $R_3$-substituted o-amino-thiophenols with $R_1$- and $R_2$-substituted p-amino-benzaldehydes, optionally in the presence of an oxidizing agent (See R. C. Elderfield, "Heterocyclic Compounds," Vol. 5, pages 508 et seq., or H. P. Lankelma et al., J. Amer. Chem. Soc. 54, 379 (1932)). Similarly, condensation of o-amino-thiophenols with $R_1$- and $R_2$-substituted p-amino-benzoic acids, according to L. C. Galatis, J. Amer. Chem. Soc. 70, 1967 (1948), results in the compounds of formula I (Method A).

The compounds in which $R_1$ is hydrogen and $R_2$ is carbalkyl, carboxyalkyl, carboxyaryl, carbamoyl or sulfamoyl are obtained, for example, from the $R_3$-substituted 2-(4'-aminophenyl)-benzothiazole derivatives by carbalkylation or carboxyalkylation, respectively, of the primary amino group (Method B).

The benzothiazole compounds of formula I in which $R_1$ is hydrogen and $R_2$ is an optionally substituted aralkyl radical are obtained by reacting the $R_3$-substituted 2-(4'-aminophenyl)-benzothiazoles with optionally substituted benzaldehydes to form the corresponding azomethines, which are very readily hydrogenated with sodium boronate in polar solvents to form the corresponding 2-(4'-benzylaminophenyl)-benzothiazole derivatives (J. H. Billmann et al., J. Org. Chem. 22, 1068 (1957)) (Method C).

Some of the benzothiazole compounds which are suitable for use in accordance with the present invention are mentioned in German Offenlegungsschrift No. 2,333,378. In this publication, certain benzothiazole compounds are described as chromogenic substances for use in pressure-sensitive recording materials, particularly in copying papers carrying on the surface of the sheet microcapsules which are broken up by pressure. The capsules contain a solution of the chromogenic substance which, upon release from the capsules, reacts with an acid substance to form a dye, either on the same or on a different sheet. It could not be anticipated that it would be possible to incorporate these leuco compounds into diazotype compositions and use them as light-absorbing compounds, without thereby entailing any coating- and application-related disadvantages.

Examples of preferred starting materials for the synthesis of the benzothiazole-leuco compounds of the present invention include, as 2-amino-thiophenols: 2-amino-thiophenol and 5-methyl-2-amino-thiophenol; and as 4-amino-benzaldehydes: 4-amino-benzaldehyde, 4-dimethylamino-benzaldehyde, 4-diethylamino-benzaldehyde, 4-N-methyl-N-benzylamino-benzaldehyde, 4-dibenzylamino-benzaldehyde, 4-N-methyl-N(2'-cyanoethylamino)-benzaldehyde and 4-N-methyl-N(4'-methoxyphenylamino)-benzaldehyde.

In the production of the diazotype coating compositions it is not necessary to use the salts of the benzothiazoles as such. A particularly simple and low-cost process comprises converting the benzothiazole-leuco compounds into their salts, by means of moderately strong or strong inorganic or organic acids, only at the time of preparing the diazotype coating compositions in the sensitizing solutions.

According to a preferred embodiment, the two-component diazotype material of the present invention comprises a single light-sensitive layer, in which a diazonium salt, a coupler component, and a benzothiazole compound are present. If several light-sensitive layers are used, the light-absorbing compound is preferably contained in the last-irradiated light-sensitive layer.

In another embodiment of the invention, the two-component diazotype material contains a mixture of a diazonium salt which absorbs light in the spectral region from 395 to 420 nm and a diazonium salt which absorbs light in the spectral region from 365 to 385 nm.

If diazonium salts are employed which absorb light in the spectral region from 395 to 420 nm, it is advantageous to use benzothiazole compounds of the formula I in which $R_1$ denotes hydrogen and $R_2$ denotes hydrogen or an alkyl, an aryl, an aralkyl, or pyridylalkyl, which is optionally substituted by halogen, alkyl, or alkoxy groups. A diazonium salt of this kind is preferably present in at least one of the light-sensitive layers.

Suitable diazonium salts which have these spectral characteristics are, for example, 4-aminobenzene diazonium salts which are substituted in the 3-position, in the 2- and 5-positions, or in the 2- and 3-positions, respectively, such as 3-methoxy-4-dimethylaminobenzene diazonium salt, 3-methoxy-4-diethylaminobenzene diazonium salt, 3-methoxy-4-N-pyrrolidinobenzene diazonium salt, 3-(n)-butoxy-4-N-piperidinobenzene diazonium salt, 2,5-dimethoxy-4-N-morpholinobenzene diazonium salt, 2,5-diethoxy-4-N-morpholinobenzene diazonium salt, 2,5-(n)-dibutoxy-4-N-morpholinobenzene diazonium salt, 2,5-diethoxy-4-N-piperidinobenzene diazonium salt, 2,5-(n)-dibutoxy-4-N(4'-methyl)-piperazinobenzene diazonium salt, 2-methyl-3-methoxy-4-dimethylaminobenzene diazonium salt, 2-methyl-3-methoxy-4-N-morpholinobenzene diazonium salt, 2-chloro-3-methoxy-4-dimethylaminobenzene diazonium salt, 2,3-dimethoxy-4-dimethylaminobenzene diazonium salt.

If, on the other hand, diazonium salts are used which absorb light in the spectral region from 365 to 385 nm, it is particularly preferred to use benzothiazole compounds of formula I in which $R_1$ denotes hydrogen or alkyl and $R_2$ denotes carbalkyl, carboxyalkyl, carboxyaryl, carbamoyl, or sulfamoyl.

Suitable diazonium compounds which have this absorption behavior are, for example, 4-aminobenzene diazonium salts which are either not substituted or are substituted in the 2-position or the benzene ring carrying the diazonium group. Examples of such compounds are 4-dimethylaminobenzene diazonium salt, 4-diethylaminobenzene diazonium salt, 4-dipropylaminobenzene diazonium salt, 4-N-morpholinobenzene diazonium salt, 4-N-pyrrolidinobenzene diazonium salt, 4-N-piperidinobenzene diazonium salt, 4-N-piperazinobenzene diazonium salt, 4-N-ethyl-N-hydroxyethylbenzene diazonium salt, 4-N-methyl-N-benzylbenzene diazonium salt, 4-N-ethyl-N-hydroxyethyl-2-methylbenzene diazonium salt, 4-diethyl-2-ethoxybenzene diazonium salt, 4-diethyl-2-carboxybenzene diazonium salt, 4-N-methyl-N-benzyl-2-trifluoromethylbenzene diazonium salt, 4-diethyl-2-chlorobenzene diazonium salt.

Benzothiazole compounds of formula I in which $R_1$ stands for hydrogen or alkyl and $R_2$ stands for hydrogen or alkyl, aralkyl, aryl or pyridylalkyl which is optionally substituted by halogen, cyano, alkyl or alkoxy groups, or in which $R_1$ and $R_2$ denote members of a heterocyclic ring, are suitable both for use together with the diazonium salts which absorb light in the spectral region from 365 to 385 nm and for use together with the diazonium salts which absorb light in the spectral region from 395 to 420 nm. Particularly preferred are those benzothiazole compounds of formula I in which $R_1$ and $R_2$ stand for hydrogen and $R_3$ stands for hydrogen or a methyl group, or in which $R_1$ stands for hydrogen or a methyl group, or in which $R_1$ stands for hydrogen, $R_2$ for an optionally substituted benzyl group, and $R_3$ for a methyl group. These benzothiazole compounds are particularly readily available. Their salts absorb light in the spectral region from 365 to 440 nm and virtually completely lose their absorptivity in an alkaline medium, while forming the corresponding benzothiazole bases.

In the case where $R_1$ and $R_2$, together with the nitrogen atom to which they are bonded, are members of a five- or six-membered heterocyclic radical, the radical may be a piperidino, a piperazino, a pyrrolidino, or a thiomorpholino radical, preferably a morpholino radical.

The most preferred light-absorbing compounds are 6-methyl-2(4'-aminophenyl)-benzothiazole, which is commercially available under the name of DEHYDROTHIOTOLUIDINE, and 6-methyl-2(4'-benzylaminophenyl)-benzothiazole.

The acids which are preferred for converting the benzothiazole-leuco bases into their yellow-dyed salts are those which are normally already present as stabilizers in diazotype layers and which do not cause precipitation in the coating solutions when used together with the benzothiazole bases. Examples of suitable acids are inorganic acids, such as sulfuric acid, hydrochloric acid, boric acid or phosphoric acid; organic acids, such as tartaric acid, citric acid, p-toluene sulfonic acid, 4-chlorobenzene sulfonic acid, 2,4,5-trimethylbenzene sulfonic acid, 5-sulfosalicylic acid and the like; or mixtures of the aforementioned acids. Particularly advantageous are mixtures of tartaric acid and boric acid, or of 5-sulfosalicylic acid and phosphhoric acid, which yield stable coating solutions and diazotype materials which have a long shelf life. In addition, these acid combinations effectively and permanently prevent a yellow discoloration of the copy background, which occasionally occurs after processing and storing the diazotype material.

For converting the benzothiazole bases into their dye salts, there is used approximately 20 to 30 parts by weight of acid, relative to the weight of the benzothiazole base. The amount of benzothioazole compound according to the present invention which is contained in the light-sensitive layer ranges between about 2 and about 30%, preferably between about 5 and about 15% by weight, based on the weight of diazonium salt.

The light-sensitive layers can be applied to the support in the conventional manner from a solution which is aqueous, aqueous-alcoholic, or purely organic. If plastic films are used as supports, it has proved advantageous to coat the support with coating solutions prepared in an organic medium which contains a film-forming binder. The amount of binder relative to the total solids content in such an organic coating solution ranges between about 50 and 90%, preferably between about 70 and about 80%, by weight, the total solids content of the coating solution being approximately 5 to 20%, preferably about 7 to about 15% by weight. The amount of the diazotype coating composition relative to the total solids content ranges between about 10 and about 40%, preferably between about 20 and 30% by weight.

Suitable film-forming binders include cellulose ethers, for example, ethyl cellulose, cellulose esters, for example, cellulose acetate, cellulose triacetate, cellulose acetopropionate, cellulose butyrate and cellulose acetobutyrate, vinyl polymers, for example, polyvinylacetate, polyvinylchloride, copolymers of vinylchloride and vinylacetate, poly-(methyl-methacrylate) copolymers, e.g., of alkyl acrylates and acrylic acid, or polyphenylene oxides or terpolymers of ethylene glycol, isophthalic acid and terephthalic acid.

In addition to the coupler components and the light-absorbing compound(s) of the present invention, the diazotype material according to the invention may contain other conventional additives, such as citric acid, tartaric acid, formic acid, p-toluene sulfonic acid, 5-sulfosalicylic acid and the like, which serve as acid stabilizers to prevent premature coupling and to stabilize the diazonium salts used. Such acid stabilizers are preferably used in concentrations of about 10 to about 50% by weight, relative to the weight of the coupler components.

It is, moreover, possible to use metal salts, such as zinc chloride, to enhance contrast, and to use carbonic acid amides, carboxylic acid amides, and carboxylic acid esters from alihphatic or aromatic monocarboxylic and dicarboxylic acids and monohydric aliphatic alcohols, as well as esters from carboxylic acids and polyhydric aliphatic alcohols, to accelerate developing. Urea, N,N-dimethylurea, glycerol diacetate and glycerol triacetate are preferably used.

To prevent yellowing and to brighten the completely exposed, developed areas of the diazotype copy, thiourea or thiourea derivatives and low-concentrated dyes, e.g., methyl violet, may additionally be incorporated into the light-sensitive layer.

In order to improve the blocking resistance of superposed diazotype materials, finely divided inorganic pigments, for example, silicic acid, aluminum oxide, etc., may be added to the light-sensitive layer.

As the supports for the light-sensitive layer(s), any of the conventionally used transparent or virtually transparent materials are suitable, for example, coated or uncoated transparent paper, cellulose esters, such as cellulose-2 ½-acetate and cellulose triacetate; polyesters, such as polyethylene terephthalate; vinyl polymers, such as polyvinyl acetate and polystyrene.

The diazotype material of the present invention is appropriately exposed by means of a light source which is rich in ultraviolet and short-wave visible radiation, for example, a high-pressure mercury-vapor lamp or a fluorescent lamp.

After exposure under a continuous-tone original, the diazotype material is treated or brought into contact with an alkaline medium, for example, the vapors of aqueous or dry ammonia, to form a colored azo-dye image in the unexposed areas and thus produce a positive copy which corresponds to the original. During developing, the dye salt of the benzothiazole compound is converted into its practically colorless leuco base. For the production of the next copy generation, almost the entire radiation spectrum of the exposure lamp is now available, so that copying speed is only slightly reduced in the generation copy. In contrast to this, copying speed in the production of the subsequent generation copies is reduced, if known ultraviolet absorbers are used in the light-sensitive layer (see German Auslegeschrift No. 1,286,879, corresponding to British Pat. No. 1,151,308, or U.S. Pat. No. 3,661,591) which do not change their absorptivity in the ultraviolet and short-wave visible spectral regions when they are irradiated or treated with an alkaline medium, since the actinic radiation which is required for exposure is filtered out by the UV-absorber remaining in the intermediate diazotype original. Moreover, undesired staining in the image background, which occurs with the known non-removable UV-absorbers, is not present in the diazotype materials of the present invention.

The invention is explained in detail by the following examples which are illustrative only.

EXAMPLE 1

A diazotype coating composition as specified below was divided into 4 portions (lacquer samples A, B, C, and D).

| | |
|---|---|
| Cellulose acetopropionate | 14.00 g |
| acetone | 135.00 g |
| methanol | 35.00 g |
| ethylene glycol monomethyl ether | 8.00 g |
| n-butanol | 8.00 g |
| 5-sulfosalicylic acid | 0.40 g |
| 2-hydroxy-3-naphthoic acid-N(2'-methoxyphenyl)-amide | 0.88 g |
| 1-hydroxy-2-naphthoic acid-N—piperidide | 0.60 g |
| 2,5-diethoxy-4-N—morpholinobenzene-diazonium tetrafluoroborate | 1.56 g |

Lacquer samples B, C, and D wer admixed with the benzothiazole-leuco base 6-methyl-2(4'-aminophenyl)-benzothiazole (Formula 2) in amounts of 10, 20 and 30% by weight, based on the weight of the diazonium salt. To convert the benzothiazole-leuco base into its dye salt, a further quantity of 25% of sulfosalicylic acid, based on the weight of the leuco base, i.e., 0.01 g, 0.02 g and 0.03 g, respectively, was added to lacquer samples B, C, and D. Lacquer sample A served as a reference.

A 10 cm wide coating knife having a gap width of 0.16 mm was then used to apply each lacquer sample to a 125 micron thick clear polyethylene terephthalate film provided with a conventional adhesive coating; the coating was dried in a circulating-air drying oven for 1 minute at 100° C., and the diazo film samples obtained were designated A, B, C, and D, in accordance with the coating samples.

Each of these film samples was then exposed to the light of a high-pressure mercury vapor lamp in a commercial continuous diazo film duplicator under a silver gray wedge which had optical density increments of about 0.15, in such a manner that, after development with moist ammonia vapors, an optical density was obtained under the first exposure step of the silver gray wedge which was by 0.02 density units higher than the density of the completely exposed and developed background of the film sample.

Film samples A, B, C, and D had different values for the speed of travel. The speed of travel determined for film sample A was 1.7 m/min. A comparison of speeds of travel shows the effective coupling speed of film samples B, C, and D, relative to film sample A.

The following values were obtained:

TABLE 1

| FILM SAMPLE | EFFECTIVE COPYING SPEED |
|---|---|
| A | 100% |
| B | 71% |
| C | 47% |
| D | 25% |

Optical density was measured in the different exposure steps of the copy of the silver gray wedge. The density values obtained are graphically represented in FIG. 1 as a function of the density of the silver gray wedge, the density values of the copy being recorded on the ordinate and the density values of the original on the abscissa. The resulting curves are known in photography and characterize the sensitometric behavior of a recording material. The influence of the concentration of benzothiazole compound on the shpe of the curve is clearly seen, the slope of curves being markedly reduced, i.e., a definite flattening of gradation is observed, in the density range from 0.2 to 1.2, which is significant from the point of view of copying technique.

The values of the slopes of curves A, B, C, and D (gamma-values) in the density range from 0.2 to 1.2 are compiled in the following Table 2.

TABLE 2

| FILM SAMPLE | GAMMA-VALUES |
|---|---|
| A | 1.72 |
| B | 1.43 |
| C | 1.23 |
| D | 1.03 |

From the values of copying speed and the gamma-values obtained for film samples A, B, C, and D, it can be seen that with increasing amounts of benzothiazole compounds the copying speeds become faster and the slopes of the sensitomeric curves become less steep, the shapes of the curves approaching the ideal behavior for true-tone density reproductions.

Similar results were obtained with benzothiazole compounds Nos. 1, 3 to 11 and 24 to 32 listed in the attached table of formulas.

EXAMPLE 2

A diazotype coating composition as specified below was divided into two equal portions (lacquer samples E and F).

| | |
|---|---|
| Cellulose acetopropionate | 7.00 g |
| acetone | 67.50 g |
| methanol | 17.50 g |
| ethylene glycol monomethyl ether | 4.00 g |
| n-butanol | 4.00 g |
| 5-sulfosalicylic acid | 0.20 g |

-continued

| | |
|---|---|
| 2-hydroxy-3-naphthoic acid-N(2'-methoxyphenyl)-amide | 0.24 g |
| 1-hydroxy-2-naphthoic acid-N—piperidide | 0.17 g |
| 4-N,N—diethylaminobenzene-diazonium tetrafluoroborate | 0.36 g |

Figure 2:
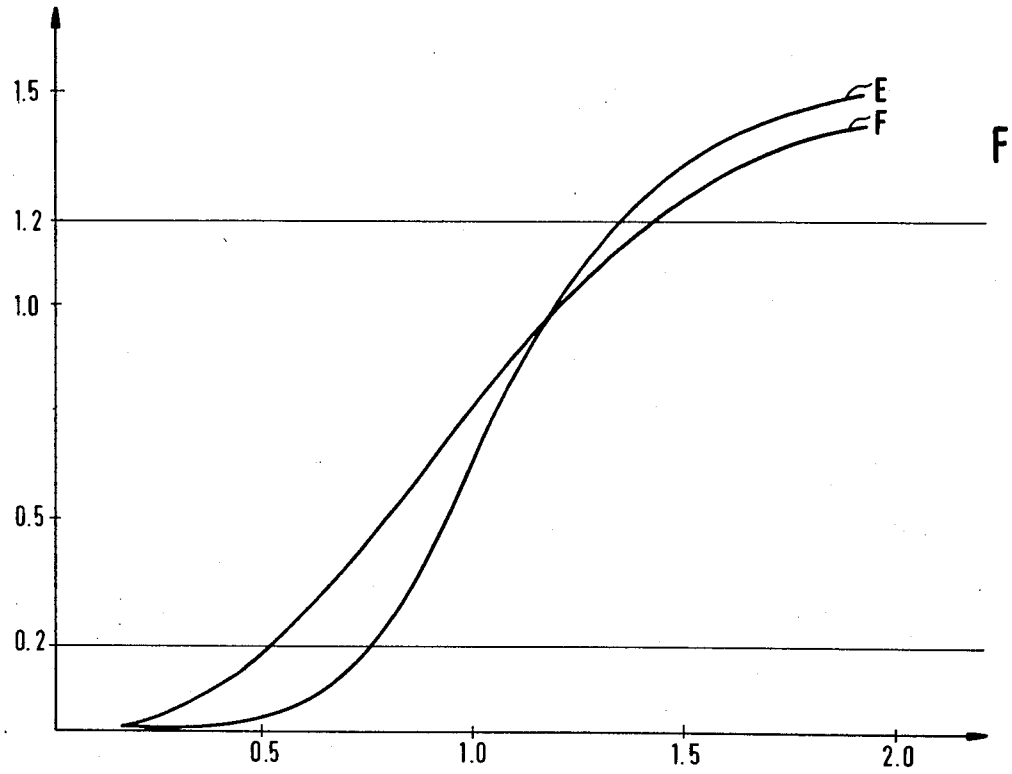

0.055 g of 6-methyl-2(4'-formylaminophenyl)-benzothiazole (Formula 12) and an additional quantity of 0.01 g of 5-sulfosalicylic acid were added to lacquer sample F. Lacquer sample E, which served as a reference, did not contain any benzothiazole compound or any additional sulfosalicylic acid. Lacquer samples E and F prepared in this manner were then used to coat a polyethylene terephthalate film, as described in Example 1, and the resulting diazo film samples E and F were exposed under a silver gray wedge in a continuous diazo film duplicator at a speed of travel of 0.4 m/min, and were then developed with moist ammonia vapor. Blue-black diazotype copies of the silver gray wedge were thus obtained. The sensitometric curves of film samples E and F are represented in FIG. 2.

Figure 3:
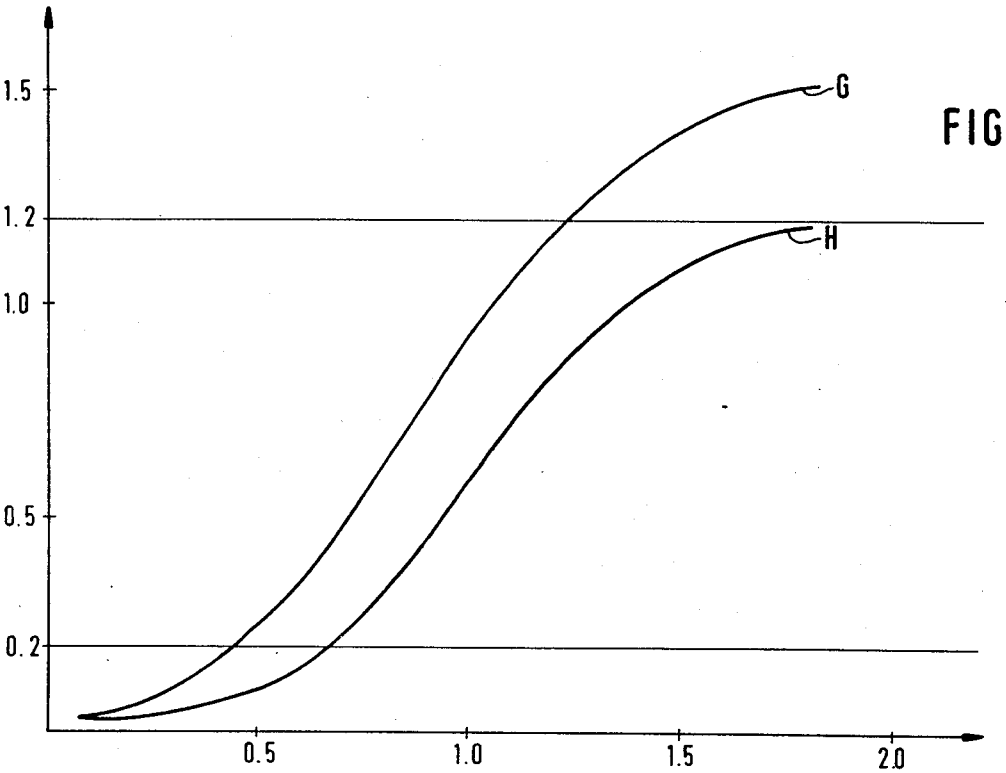

When the 4-N,N-diethylaminobenzene-diazonium-tetrafluoroborate in the above-defined lacquer solution was replaced by the equimolar quantity of 0.42 g of 4-N,N-diethylamino-2-ethoxybenzene-diazonium-fluoroborate and 0.055 g of 6-methyl-2(4'-propionylaminophenyl)-benzothiazole (Formula 20) and 0.01 g of sulfosalicylic acid were added to one half of the lacquer thus prepared, diazo film samples G (reference sample) and H were obtained after coating the lacquer samples on films and drying them. These samples were exposed and developed in accordance with film samples E and F. Blue-black diazotype copies of the silver gray wedge were thus obtained. The sensitometric curves of film samples G and H are shown in FIG. 3.

The influence of the 6-methyl-2(4'-formylaminophenyl)-benzothiazole or of the 6-methyl-2(4'-proprionylaminophenyl)benzothiazole on the shape of the sensitometric curves of diazo film samples F and H is very clearly seen.

The gamma-values for the slopes of the sensitometric curves E, F, G, and H, in the density range from 0.2 to 1.2, are listed in Table 3.

TABLE 3

| FILM SAMPLE | GAMMA-VALUES |
|---|---|
| E (reference sample) | 2.13 |
| F | 1.27 |
| G (reference sample) | 1.32 |
| H | 0.88 |

Similar results are obtained when benzothiazole compounds Nos. 13 to 19 and 21 to 23 listed in the table of formulas and diazonium salts having a maximum absorption in the spectral region from 365 to 385 nm are used.

EXAMPLE 3

As described in Example 1, a polyethylene terephthalate film provided with a conventional adhesive coating was coated with a lacquer solution of the below-specified composition and then dried (layer thickness 7.5 microns).

| | |
|---|---|
| Cellulose acetopropionate | 7.00 g |
| acetone | 67.50 g |
| methanol | 17.50 g |
| ethylene glycol monomethyl ether | 4.00 g |
| n-butanol | 4.00 g |
| tartaric acid | 0.58 g |
| boric acid | 0.14 g |
| 2-methyl resorcinol | 0.29 g |
| 2,2',4,4'-tetrahydroxydiphenyl-sulfide | 0.04 g |
| 6-methoxy-2-hydroxy-3-naphthoic acid-N(3-morpholinopropyl)-amide | 0.32 g |
| 2,3-dihydroxynaphthalene-6-sulfonic acid-N(4'-chlorophenyl)-amide | 0.14 g |
| N,N'—dimethyl urea | 0.10 g |
| 2,5-dibutoxy-4-morpholinobenzene-diazonium fluoroborate | 0.89 g |
| N,N—diethylaminobenzene-diazonium fluoroborate | 0.08 g |
| 6-methyl-2(4'-benzylaminophenyl)-benzothiazole (Formula 24) | 0.17 g |

Figure 4:
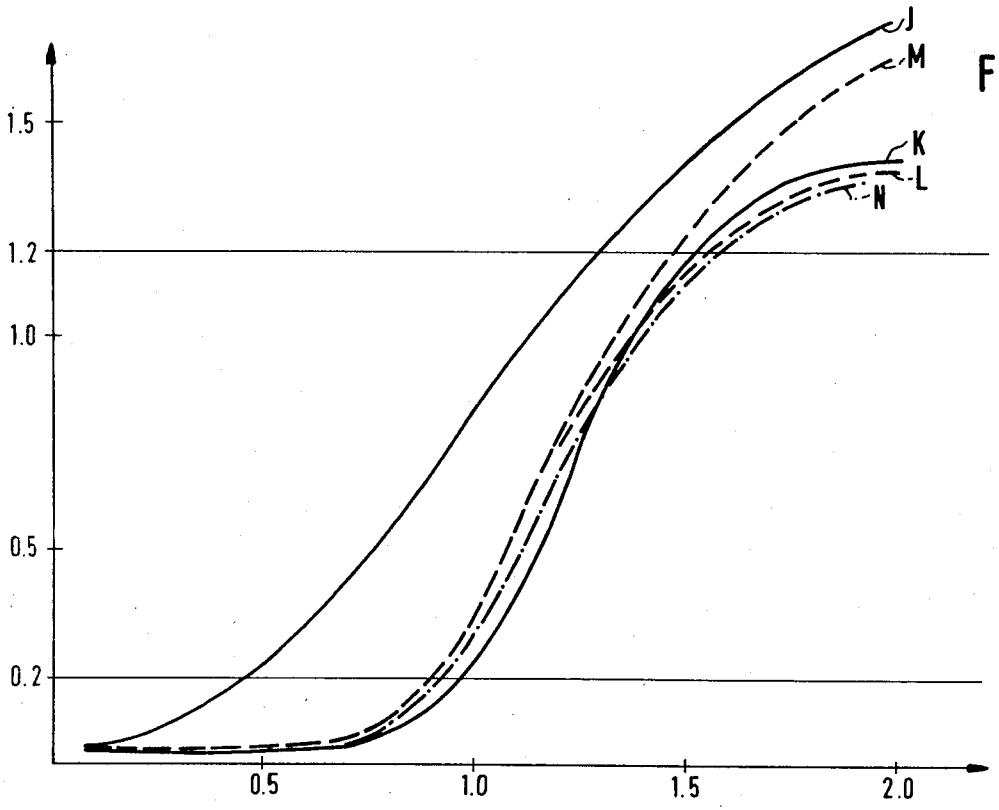

The resulting diazotype material J was exposed under a silver gray wedge in a continuous diazo film duplicator at a speed of 0.4 m/min, and was then developed with moist ammonia vapors. A neutral-black diazotype copy of the original silver step wedge was thus obtained. To determine the gamma-value of gradation, the shape of the sensitometric curve was graphically represented (FIG. 4).

When the same quantities by weight of benzothiazole compounds Nos. 25 to 32 listed in the table of formulas were substituted for the 6-methyl-2(4'-benzylaminophenyl)-benzothiazole, similar results were obtained relative to color shade of the copies, shape of the sensitometric curves, and gamma-values. A diazo film K serving as a reference, which did not contain any benzothiazole compound, had a considerably higher contrast, i.e., it showed a clearly steeper shape of the sensitometric curve, as is depicted in FIG. 4.

When the 6-methyl-2(4'-benzylaminophenyl)-benzothiazole was replaced by the same parts by weight of the UV-absorbers mentioned in German Pat. Nos. 1,286,897 and 1,204,069 and in U.S. Pat. No. 3,661,591, diazo film materials L, M, and N were obtained which showed a clearly steeper shape of the sensitometric curves and correspondingly yielded markedly higher gamma-values. The shape of curves approximately corresponded to the shape of curve obtained for a diazotype material without UV-absorber (FIG. 4).

The above results show that it is virtually impossible to change the shape of the sensitometric curves of diazotype materials which predominantly or exclusively contain benzene diazonium salts having a maximum absorption in the spectral region between 395 and 420 nm, by means of the prior art UV-absorbers.

In the following Table 4, the gamma-values of gradation were compiled for diazo film samples J, K, L, M, and N.

TABLE 4

| FILM SAMPLE | GAMMA-VALUE | UV-ABSORBER |
|---|---|---|
| J | 1.19 | 6-methyl-2(4'-benzylaminophenyl)-benzothiazole |
| K | 1.97 | none |
| L | 1.78 | 1-(4'-(Beta-methylamino-ethyl-sulfonyl)-phenyl)-3-p-chloro-phenyl-Delta$_2$-pyrazoline |

TABLE 4-continued

| FILM SAMPLE | GAMMA-VALUE | UV-ABSORBER |
|---|---|---|
| | | (German Patent No. 1,286,897) |
| M | 1.87 | 7-diethylamino-4-methyl-coumarin (U.S. Pat. No. 3,661,591) |
| N | 1.78 | 2,2'-dihydroxy-4,4'-dimethoxy-benzophenone (German Patent No. 1,204,069) |

EXAMPLE 4

Ten lacquer solutions were prepared which differed only in the type of UV-absorber added. Nine different UV-absorbers were used in the individual lacquer solutions and of these, UV-absorbers II to VII comprised, in each case, benzothiazole compounds of the present invention, while UV-absorbers VIII to X comprised the known compounds used for film samples L, N, and M (Table 4).

| Composition of the lacquer solution: | |
|---|---|
| cellulose acetopropionate | 3.50 g |
| acetone | 33.75 g |
| methanol | 8.75 g |
| n-butanol | 2.00 g |
| ethylene glycol monomethyl ether | 2.00 g |
| tartaric acid | 0.29 g |
| boric acid | 0.07 g |
| UV-absorber (II to X) | 0.05 g |

Each of these lacquer solutions was coated on a polyethylene terephthalate film, using the coating knife mentioned in Example 1, and was then dried. Optical densities at the wavelengths of 365 nm and 405 nm, respectively, were then determined prior to and also after treatment with moist ammonia gas, by means of a commerical densitometer. The results obtained were as follows:

| | | | OPTICAL DENSITY | |
|---|---|---|---|---|
| UV-ABSORBER | | Lambda (nm) | Before Treatment | After Treatment with Ammonia |
| I | [none] | 405 | 0.06 | 0.06 |
| II | 6-methyl-2(4'-aminophenyl)-benzothiazole (Formula 2) | 405 | 0.13 | 0.06 |
| III | 6-methyl-2(4'-benzylamino-phenyl)-benzothiazole (Formula 24) | 405 | 0.42 | 0.07 |
| IV | 2(4'-dibenzylaminophenyl)-benzothiazole (Formula 8) | 405 | 0.43 | 0.07 |
| V | 6-methyl-2(4'-formylamino-phenyl)-benzothiazole (Formula 12) | 365 | 0.36 | 0.06 |
| VI | 6-methyl-2(4'-propionyl-aminophenyl)-benzothiazole (Formula 20) | 365 | 0.38 | 0.06 |
| VII | 6-methyl-2(4'-carbethoxy-aminophenyl)-benzothiazole (Formula 17) | 365 | 0.40 | 0.06 |
| VIII | 1-(4'-(Beta-methylamino-ethyl-sulfonyl)-phenyl)-3-p-chlorophenyl-Delta$_2$-pyrazoline | 365<br>405 | 0.43<br>0.12 | 0.43<br>0.12 |
| IX | 7-diethylamino-4-methyl-coumarin | 365 | 0.06 | 0.43 |
| X | 2,2'-dihydroxy-4,4'-di-methoxybenzophenone | 365 | 0.27 | 0.16 |

The results given above show that only the benzothiazole derivatives II to VII of the present invention practically completely lose their absorptivitiy under the action of ammonia vapors, as evidenced by the decrease of optical density down to 0.06 to 0.07. As a consequence, background staining caused by the UV-absorber does not occur. Moreover, diazo film intermediate originals which contain one of the benzothiazole derivatives of the invention as the UV-absorber can be used for producing further diazo film copies without any loss of exposure speed, since, in the alkaline development of the diazo film intermediate original, the benzothiazole UV-absorber of the invention loses its absorptivity towards the actinic radiation of the exposure lamps.

If, on the other hand, the prior art UV-absorbers are used, optical density before and after the alkaline treatment with ammonia gas is either unchanged (VIII), is increased (IX), or is reduced by only a fraction (X). As a result, a high residual absorption remains, even after the alkaline treatment, which leads to an undesired staining of the copy background and reduces processing speed in the production of subsequent generation copies.

EXAMPLE 5

A polyethylene terephthalate film provided with a conventional adhesive coating was coated with a first layer of the composition O as specified below, using a 10 cm wide coating knife having a gap width of 0.09 mm.

| COMPOSITION O | |
|---|---|
| Cellulose acetopropionate | 3.5 g |
| acetone | 33.75 g |
| methanol | 8.75 g |
| ethylene glycol monomethyl ether | 2.00 g |
| n-butanol | 2.00 g |
| tartaric acid | 0.12 g |
| boric acid | 0.03 g |
| 2-hydroxy-3-naphthoic acid-N(2'-methoxyphenyl)-amide | 0.22 g |
| 1-hydroxy-2-naphthoic acid-N—piperidide | 0.15 g |
| 4-N,N—dipropylaminobenzene-diazonium-tetrafluoroborate | 0.20 g |
| 6-methyl-2(4'-p-chlorobenzyl-amino)-phenyl)-benzothiazole (Formula 27) | 0.04 g |

The resulting diazotype material O was well dried.

For the preparation of a multilayer diazotype material containing the compound according to formula 27 of the present invention, a second layer of the composition Q, as specified below, was applied to the first layer of diazotype material O, using a 10 cm wide coating knife having a gap width of 0.09 mm, and was dried.

| COMPOSITION Q | |
|---|---|
| Cellulose acetobutyrate | 3.5 g |
| ethanol | 45.00 g |
| water | 1.5 g |
| tartaric acid | 0.12 g |
| boric acid | 0.03 g |
| 2-hydroxy-3-naphthoic acid-N(2'-methoxyphenyl)-amide | 0.22 g |
| 1-hydroxy-2-naphthoic acid-N—piperidide | 0.15 g |
| 2,5-dibutoxy-4-N—morpholinobenzene-diazonium-tetrafluoroborate | 0.45 g |

The resulting diazotype material P was exposed under a silver gray step wedge in a continuous diazo film duplicator, at a speed of 0.4 m/min and was then developed with moist ammonia vapors. A blue-black dazo film copy of the original was thus obtained. In order to determine the gamma-value of gradation, the shape of the sensitometric curve of diazotype material P was graphically represented in FIG. 5. Similar results are obtained, if the 6-methyl-2(4'-(p-chlorobenzylamino)-phenyl)-benzothiazole is replaced by the same quantities by weight of the benzothiazole derivatives compiled in the table of formulas below.

The foregoing results show that the multilayer diazotype material of the invention reproduces optical density values at nearly correct tone values over a relatively broad density range.

Figure 5:
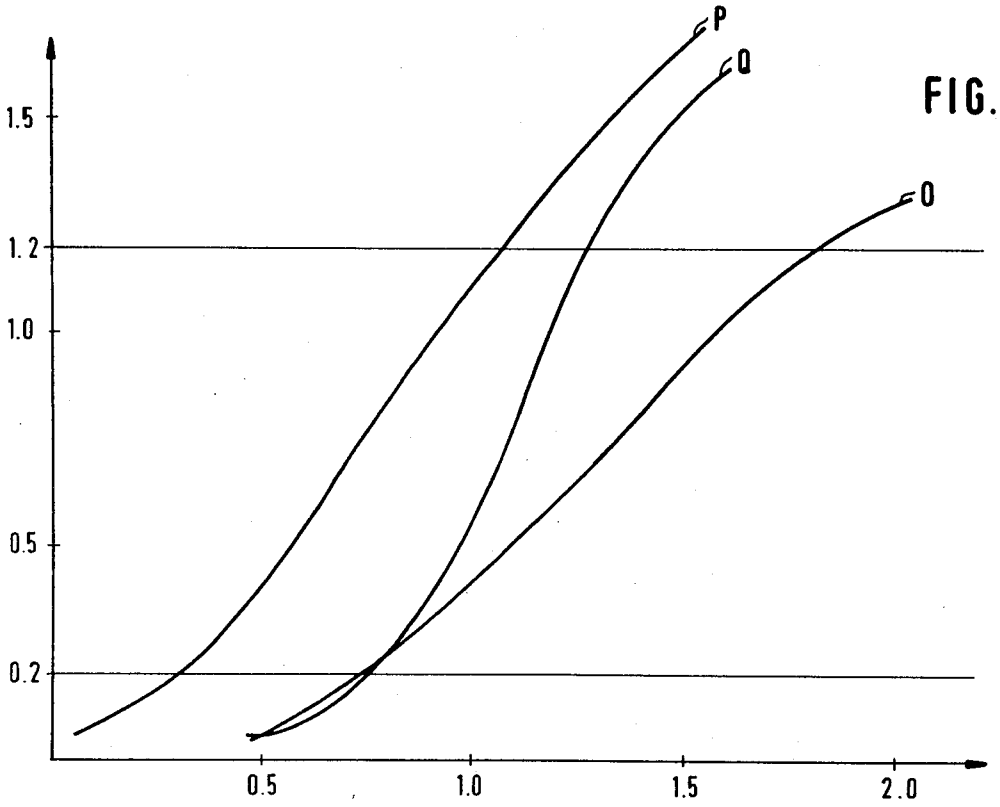

For comparison, FIG. 5 shows the sensitometric curves of diazotype materials O and Q, which were prepared using compositions O and Q and were processed as described for the multilayer diazotype material P.

TABLE 5

| FILM SAMPLE | GAMMA-VALUES |
|---|---|
| O | 0.93 |
| P | 1.32 |
| Q | 1.96 |

EXAMPLE 6

As described in Example 1, a polyethylene terephthalate film provided with a conventional adhesive coating was coated with a diazo-lacquer solution of the composition specified below and dried.

| | |
|---|---|
| Cellulose acetopropionate | 7.00 g |
| acetone | 67.50 g |
| methanol | 17.50 g |
| ethylene glycol monomethyl ether | 4.00 g |
| n-butanol | 4.00 g |
| 5-sulfosalicylic acid | 0.23 g |
| phosphoric acid (85% strength) | 0.13 g |
| 2-methyl resorcinol | 0.19 g |
| 2,2',4,4'-tetrahydroxy-diphenylsulfide | 0.04 g |
| 6-methoxy-2-hydroxy-3-naphthoic acid-N(3-morpholino-propyl)-amide | 0.32 g |
| 2,3-dihydroxynaphthalene-6-sulfonic acid N(4'-chlorophenyl)-amide | 0.14 g |
| N,N'—dimethyl urea | 0.10 g |
| 2,5-dibutoxy-4-morpholinobenzene-diazonium-fluoroborate | 0.89 g |
| N,N—diethylaminobenzene-diazonium-fluoroborate | 0.08 g |
| 6-methyl-2(4'-benzylaminophenyl)-benzothiazole (Formula 24) | 0.12 g |

The resulting diazotype material R was exposed under a silver gray wedge in a continuous diazo film duplicator at a speed of 0.4 m/min, and was then developed with moist ammonia vapor. A neutral to slightly blue-tinged black copy of the original gray wedge was thus obtained.

The gamma-value of gradation was comparable to that of the diazotype copies according to film sample C.

The unprocessed diazotype material had a good shelf life at a temperature of 55° C. and 65% relative humidity.

TABLE OF FORMULAE

| No. | $R_1$ | $R_2$ | $R_3$ | MP °C. | Method of Synthesis |
|---|---|---|---|---|---|
| 1 | H | H | H | 148–149 | A |
| 2 | H | H | 6-$CH_3$ | 193–194 | A |
| 3 | H | $-CH_3$ | 6-$CH_3$ | 165–167 | |
| 4 | $-CH_3$ | $-CH_3$ | H | 172 | A |
| 5 | $-C_2H_5$ | $-C_2H_5$ | H | 123–124 | A |
| 6 | $-C_4H_9$(n) | $-C_4H_9$(n) | H | 160–163 (HCl—salt) | A |
| 7 | $-CH_3$ | $-CH_2-C_6H_5$ | H | 157–158 | A |
| 8 | $-CH_2-C_6H_5$ | $-CH_2-C_6H_5$ | H | 177–180 | A |
| 9 | $-CH_3$ | $-C_6H_4-OCH_3$ | H | 131–133 (HCl—salt) | A |
| 10 | $CH_2-CH_2-O-CH_2-CH_2$ | | H | 273 | A |
| 11 | $-CH_3$ | $-CH_2CH_2CN$ | H | 145–146 | A |
| 12 | H | $-C(=O)-H$ | 6-$CH_3$ | 216–217 | B |
| 13 | H | $-C(=O)-CH_3$ | H | 226–228 | B |
| 14 | H | $-C(=O)-CH_3$ | 6-$CH_3$ | 225–227 | B |
| 15 | H | $-S(=O)_2-CH_3$ | 6-$CH_3$ | 228 (decomp.) | B |
| 16 | H | $-C(=O)-NH_2$ | 6-$CH_3$ | 300 | B |
| 17 | H | $-C(=O)-OC_2H_5$ | 6-$CH_3$ | 168–169 | B |
| 18 | H | $-C(=O)-C_6H_5$ | 6-$CH_3$ | 243–245 | B |
| 19 | H | $-C(=O)-CH_2-C_6H_5$ | 6-$CH_3$ | 213–214 | B |
| 20 | H | $-C(=O)-C_3H_7$ | 6-$CH_3$ | 210–212 | B |
| 21 | H | $-C(=O)-O-C_6H_5$ | 6-$CH_3$ | 300 | B |

-continued

TABLE OF FORMULAE

| No. | $R_1$ | $R_2$ | $R_3$ | MP °C. | Method of Synthesis |
|---|---|---|---|---|---|
| 22 | H | $-\underset{\underset{O}{\parallel}}{C}-OC_4H_9$ | 6-$CH_3$ | 300 | B |
| 23 | $-CH_3$ | $-\underset{\underset{O}{\parallel}}{C}-CH_3$ | 6-$CH_3$ | 138–140 | B |
| 24 | H | 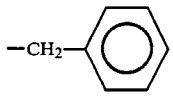 | 6-$CH_3$ | 147–150 | C |
| 25 | H | 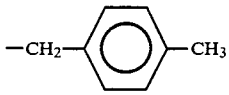 | 6-$CH_3$ | 160–161 | C |
| 26 | H | 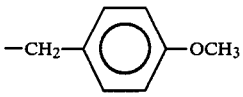 | 6-$CH_3$ | 159–161 | C |
| 27 | H | 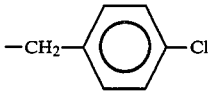 | 6-$CH_3$ | 181–182 | C |
| 28 | H | 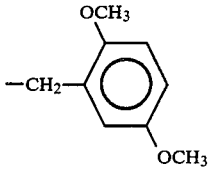 | 6-$CH_3$ | 145–147 | C |
| 29 | H | 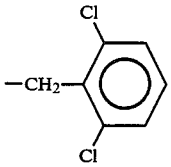 | 6-$CH_3$ | 196–198 | C |
| 30 | H | 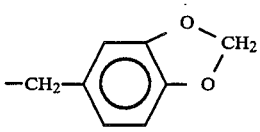 | 6-$CH_3$ | 153–155 | C |
| 31 | H | 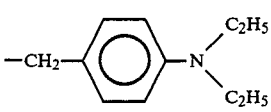 | 6-$CH_3$ | 131–133 | C |
| 32 | H | 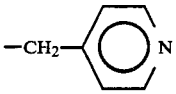 | 6-$CH_3$ | 205–208 | C |

What is claimed is:

1. A two-component diazotype material, comprising a support and at least one light-sensitive layer provided on said support, said layer containing in admixture at least one light-sensitive diazonium salt, a coupler component, and an acid stabilizer, wherein at least one layer further contains in said admixture a light-absorbing compound which absorbs light in the ultraviolet spectral region, said light-absorbing compound (i) being present in an amount between about 2 and 30%, based on the weight of said diazonium salt and (ii) comprising a dye salt of at least one benzothiazole which is capable of converting into a corresponding leuco base by the action of an alkaline medium, whereby said dye salt at least partially loses absorptivity toward radiation in the long-wave ultraviolet and short-wave visible spectral region.

2. A diazotype material as claimed in claim 1, wherein the light-absorbing compound comprises a benzothiazole of the formula

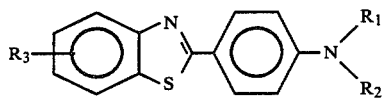

(I)

wherein $R_1$ denotes hydrogen, alkyl or aralkyl, $R_2$ denotes hydrogen or a substituted or unsubstituted alkyl, aralkyl, aryl, pyridylalkyl, carbalkyl, carboxyalkyl, carboxyaryl, carbamoyl or sulfamoyl radical, or $R_1$ and $R_2$ together represent members of a heterocyclic radical, and $R_3$ denotes hydrogen or alkyl.

3. A diazotype material as claimed in claim 2, wherein $R_1$ denotes hydrogen, an alkyl having from 1 to 4 carbon atoms, or an aralkyl having up to 10 carbon atoms, $R_2$ denotes hydrogen, an alkyl radical having from 1 to 4 carbon atoms, an aralkyl radical having up to 10 carbon atoms, or an aryl radical, a pyridylalkyl radical having from 1 to 4 carbon atoms in the alkyl group, a carbalkyl radical having from 1 to 4 carbon atoms, a carboxyalkyl radical having from 1 to 4 carbon atoms, a carboxyaryl radical having up to 10 carbon atoms, a carbamoyl, or a sulfamoyl radical, said radicals being substituted by halogen, amino, mono- or dialkylamino, cyano, alkyl, alkoxy, or alkylenedioxy groups which have, in each case, from 1 to 3 carbon atoms in the alkyl radical, or $R_1$ and $R_2$ represent, together with the nitrogen atom to which they are bonded, members of a five- or six-membered heterocyclic radical, and $R_3$ denotes hydrogen or alkyl having 1 to 2 carbon atoms.

4. A diazotype material as claimed in claim 2, wherein $R_1$ denotes hydrogen or alkyl, $R_2$ denotes hydrogen or an alkyl, aralkyl, aryl, or pyridylalkyl radical which is unsubstituted or substituted by a halogen, a cyano, an alkyl, or an alkoxy group.

5. A diazotype material as claimed in claim 4, wherein $R_1$ denotes hydrogen or a methyl group, $R_2$ denotes hydrogen, and $R_3$ denotes hydrogen or a methyl group.

6. A diazotype material as claimed in claim 4, wherein $R_1$ denotes hydrogen, $R_2$ denotes a substituted or unsubstituted benzyl group, and $R_3$ denotes a methyl group.

7. A diazotype material as claimed in claim 3, wherein $R_1$ and $R_2$ represent, together with the nitrogen atom to which they are bonded, members of a five- or six-membered heterocyclic radical selected from the group comprising a piperidino radical, a piperazino radical, a pyrrolidino radical, and a thiomorpholino radical.

8. A diazotype material as claimed in claim 1, wherein said light-absorbing compound comprises 6-methyl-2(4'-aminophenyl)-benzothiazole.

9. A diazotype material as claimed in claim 1, wherein said light-absorbing compound comprises 6-methyl-2(4'-benzylaminophenyl)-benzothiazole.

10. A diazotype material as claimed in claim 1, wherein said dye salt is the conversion product of a reaction between the base corresponding to said dye salt and a mixture of tartaric acid and boric acid.

11. A diazotype material as claimed in claim 1, wherein said dye salt is the conversion product of a reaction between the base corresponding to said dye salt and a mixture of 5-sulfosalicylic acid and phosphoric acid.

12. A diazotype material as claimed in claim 1, which comprises a single light-sensitive layer.

13. A diazotype material as claimed in claim 1, wherein said light-absorbing compound is contained in the last-irradiated light-sensitive layer provided on said support.

14. A diazotype material as claimed in claim 1, wherein said light-sensitive diazonium salt comprises a mixture of a first diazonium salt which absorbs light in the spectral region between about 395 and about 420 nm and a second diazonium salt which absorbs light in the spectral region between about 365 and about 385 nm.

15. A diazotype material as claimed in claim 14, wherein said first diazonium salt comprises a benzothiazole of the formula

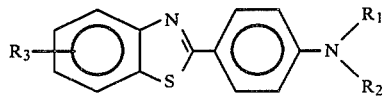

wherein $R_1$ denotes hydrogen, $R_2$ denotes hydrogen or a substituted or unsubstituted radical selected from the group consisting of aryl, aralkyl, and pyridylalkyl, and $R_3$ denotes hydrogen or an alkyl group.

16. A diazotype material as claimed in claim 15, wherein said substituted radical denoted by $R_2$ is substituted by a halogen, an alkyl group, or an alkoxy group.

17. A diazotype material as claimed in claim 14, wherein said second diazonium salt comprises a benzothiazole of the formula

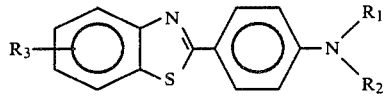

wherein $R_1$ denotes hydrogen or an alkyl group, $R_2$ denotes a carbalkyl radical, carboxyalkyl radical, a carboxyaryl radical, a carbamoyl radical, or a sulfamoyl radical, and $R_3$ denotes hydrogen or an alkyl group.

18. A diazotype material as claimed in claim 1, comprising at least one light-sensitive layer which contains a diazonium salt which absorbs in the spectral region between about 395 and about 420 nm.

19. A diazotype material as claimed in claim 1, wherein said dye salt is yellow and said corresponding leuco base is substantially colorless.

* * * * *